US007325907B2

(12) United States Patent
Hoisington et al.

(10) Patent No.: US 7,325,907 B2
(45) Date of Patent: Feb. 5, 2008

(54) PRINTHEAD

(75) Inventors: Paul A. Hoisington, Norwich, VT (US); John C. Batterton, Los Gatos, CA (US); Andreas Bibl, Los Altos, CA (US); Brian Walsh, Hanover, NH (US)

(73) Assignee: Fujifilm Dimatix, Inc., Lebanon, NH (US)

( * ) Notice: Subject to any disclaimer, the term of this patent is extended or adjusted under 35 U.S.C. 154(b) by 122 days.

(21) Appl. No.: 10/990,789

(22) Filed: Nov. 17, 2004

(65) Prior Publication Data

US 2006/0103699 A1 May 18, 2006

(51) Int. Cl.
*B41J 2/07* (2006.01)

(52) U.S. Cl. ..... 347/74

(58) Field of Classification Search ..... 347/54, 347/56, 68, 73–75, 84–85, 92; 216/27
See application file for complete search history.

(56) References Cited

U.S. PATENT DOCUMENTS 4,788,556 A 11/1988 Hoisington et al.
4,940,995 A 7/1990 Hine et al.
4,961,082 A 10/1990 Hoisington et al.
4,995,940 A * 2/1991 Hine et al. ..... 216/27
5,701,148 A 12/1997 Moynihan et al.
5,742,313 A 4/1998 Hine
6,655,787 B1 * 12/2003 Hawkins ..... 347/54
6,660,648 B1 12/2003 Galambos et al.
2004/0004649 A1 1/2004 Bibl et al.

FOREIGN PATENT DOCUMENTS

JP 61-024458 2/1986

OTHER PUBLICATIONS

Kim et al., "Nanostructured Surfaces for Dramatic Reduction of Flow Resistance in Droplet-Based Microfluidics", IEEE Conf. MEMS, Las Vegas, NV, pp. 479-482, Jan. 2002.
Keiran Lindsey, "DMD00 The 2000 Guide to the Membrane Industry", Dec. 2000.
Galambos et al., "Silicon Nitride Membranes for Filtration and Separation", ASME Winter Annual Meeting, Los Angeles, CA, Nov. 1998.
Robert T. DeHoff, "Capillarity Effects in Thermodynamics", Thermodynamics in Materials Science, pp. 355-401, 1993.

* cited by examiner

*Primary Examiner*—K. Feggins
(74) *Attorney, Agent, or Firm*—Fish & Richardson P.C.

(57) ABSTRACT

Devices used to degas and eject fluid drops are disclosed. Devices include a flow path that includes a pumping chamber in which fluid is pressurized for ejection of a fluid drop, and a semi-permeable membrane including an inorganic material having an outer surface positioned in fluid contact with the flow path. The membrane allows gases to pass therethrough, while preventing liquids from passing therethrough.

31 Claims, 3 Drawing Sheets

PRINTHEAD

TECHNICAL FIELD

This invention relates to printheads, and more particularly to a membrane for degassing fluids in a printhead.

BACKGROUND

Ink jet printers typically include an ink path from an ink supply to a nozzle path. The nozzle path terminates in a nozzle opening from which ink drops are ejected. Ink drop ejection is controlled by pressurizing ink in the ink path with an actuator, which may be, for example, a piezoelectric deflector, a thermal bubble jet generator, or an electrostatically deflected element. A typical printhead has an array of ink paths with corresponding nozzle openings and associated actuators, such that drop ejection from each nozzle opening can be independently controlled. In a drop-on-demand printhead, each actuator is fired to selectively eject a drop at a specific pixel location of an image as the printhead and a printing substrate are moved relative to one another. In high performance printheads, the nozzle openings typically have a diameter of 50 microns or less, e.g. around 35 microns, are separated at a pitch of 100-300 nozzle/inch, have a resolution of 100 to 3000 dpi or more, and provide drop sizes of about 1 to 70 picoliters or less. Drop ejection frequency is typically 10 kHz or more.

Printing accuracy of printheads, especially high performance printheads, is influenced by a number of factors, including the size and velocity uniformity of drops ejected by the nozzles in the printhead. The drop size and drop velocity uniformity are in turn influenced by a number of factors, such as the presence of dissolved gases or bubbles in ink flow paths.

SUMMARY

Generally, the invention relates to printheads for drop ejection devices, such as ink jet printers, and membranes for degassing fluids.

In an aspect, the invention features a drop ejector system that includes a flow path extending between a reservoir region and an ejection nozzle. The flow path includes a pumping chamber in which fluid is pressurized for ejection of a fluid drop. A membrane that includes a semi-permeable nitride is positioned in fluid contact with the flow path.

In another aspect, the invention features a drop ejector system that includes a flow path extending between a reservoir region and an ejection nozzle. The flow path includes a pumping chamber in which fluid is pressurized for ejection of a fluid drop. A membrane having a permeability to He of about $1\times10^{-10}$ mols/($m^2$Pa-s) to about $1\times10^{-6}$ mols/($m^2$Pa-s) at room temperature is positioned in fluid contact with the flow path.

In another aspect, the invention features a drop ejector system that includes a flow path extending between a reservoir region and an ejection nozzle. The flow path includes a pumping chamber in which fluid is pressurized for ejection of a fluid drop. A membrane having fractures that have a cross sectional dimension no greater than about 100 nm is positioned in fluid contact with the flow path.

In another aspect, the invention features a drop ejector that includes a flow path that includes a pumping chamber in which fluid is pressurized for ejection of a fluid drop. A semi-permeable membrane that includes an inorganic material formed by exposure to plasma to modify gas permeability, the membrane having an outer surface is positioned in fluid contact with the flow path. The membrane allows gases to pass therethrough, while preventing liquids from passing therethrough.

Other aspects or embodiments may include combinations of the features in the aspects above and/or one or more of the following. The membrane includes microfractures. The membrane is porous. The membrane includes a first surface in fluid contact with the flow path and a second surface in contact with a vacuum region. The membrane is permeable to gas, but not to liquid. The membrane is permeable to air. The membrane is substantially impermeable to ink used in the drop ejector system. The nitride is, e.g., a silicon nitride. The membrane was exposed to a reactive ion etchant. The membrane has a permeability to He of at least about $1.6\times10^{-8}$ mols/($m^2$Pa-s) at room temperature, e.g., less than about $1\times10^{-10}$ mols/($m^2$Pa-s) at room temperature. The drop ejector system may include multiple flow paths. When the membrane includes fractures, the fractures have a cross-sectional dimension no greater than about 250 nm, e.g., no greater than about 100 nm. In addition to a nitride, e.g., a silicon nitride, a titanium nitride, or a tungsten nitride, the membrane can include other materials, for example, ceramics, e.g., carbides, e.g., silicon carbide. In other aspects, the invention includes methods of forming a membrane on a printhead, as described herein.

Embodiments may have one or more of the following advantages. The membrane can be incorporated into the flow path of a printhead, thereby allowing ink to be degassed in close proximity to a pumping chamber in a MEMS style ink jet printhead. As a result, the ink can be degassed efficiently, which leads to improved purging processes within the printhead as well as improved high frequency operation. As a further result, the size of the printhead can be minimized by the incorporation of the membrane within the flow path and the elimination of a separate deaeration device.

Still other aspects, features, and advantages follow. For example, particular aspects include membrane dimensions, characteristics, and operating conditions described below.

DESCRIPTION OF DRAWINGS

Like reference symbols in the various drawings indicate like elements.

DETAILED DESCRIPTION

Figure 1:
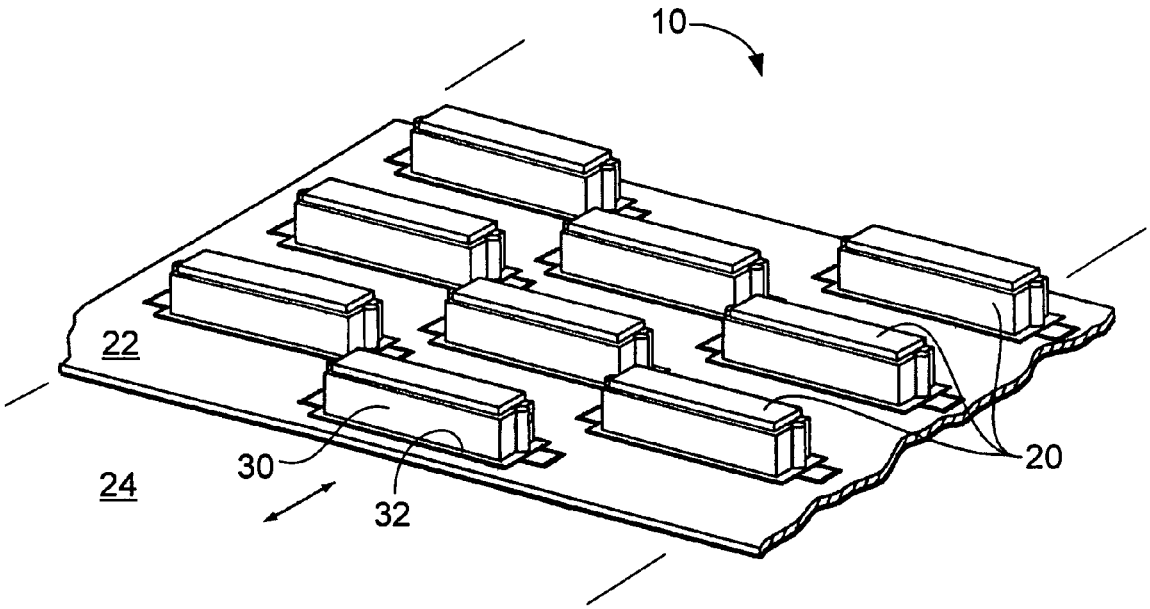
FIG. 1 is a perspective view of a printhead.

Referring to FIG. 1, an ink jet printhead 10 includes printhead units 20 which are held in an enclosure 22 in a manner that they span a sheet 24, or a portion of the sheet, onto which an image is printed. The image can be printed by selectively jetting ink from the units 20 as the printhead 10 and the sheet 24 move relative to one another (arrow). In the embodiment in FIG. 1, three sets of printhead units 20 are illustrated across a width of, for example, about 12 inches or more. Each set includes multiple printhead units, in this case three, along the direction of relative motion between the printhead 10 and the sheet 24. The units can be arranged to offset nozzle openings to increase resolution and/or printing speed. Alternatively, or in addition, each unit in each set can be supplied ink of a different type or color. This arrangement can be used for color printing over the full width of the sheet in a single pass of the sheet by the printhead.

Each printhead unit 20 includes a manifold assembly 30, which is positioned on a faceplate 32, and to which is attached a flex print (not shown) located within the manifold assembly 30 for delivering drive signals that control ink ejection. Each manifold assembly 30 includes flow paths for delivering ink to nozzle openings in the faceplate 32 for ink ejection.

Figure 2:
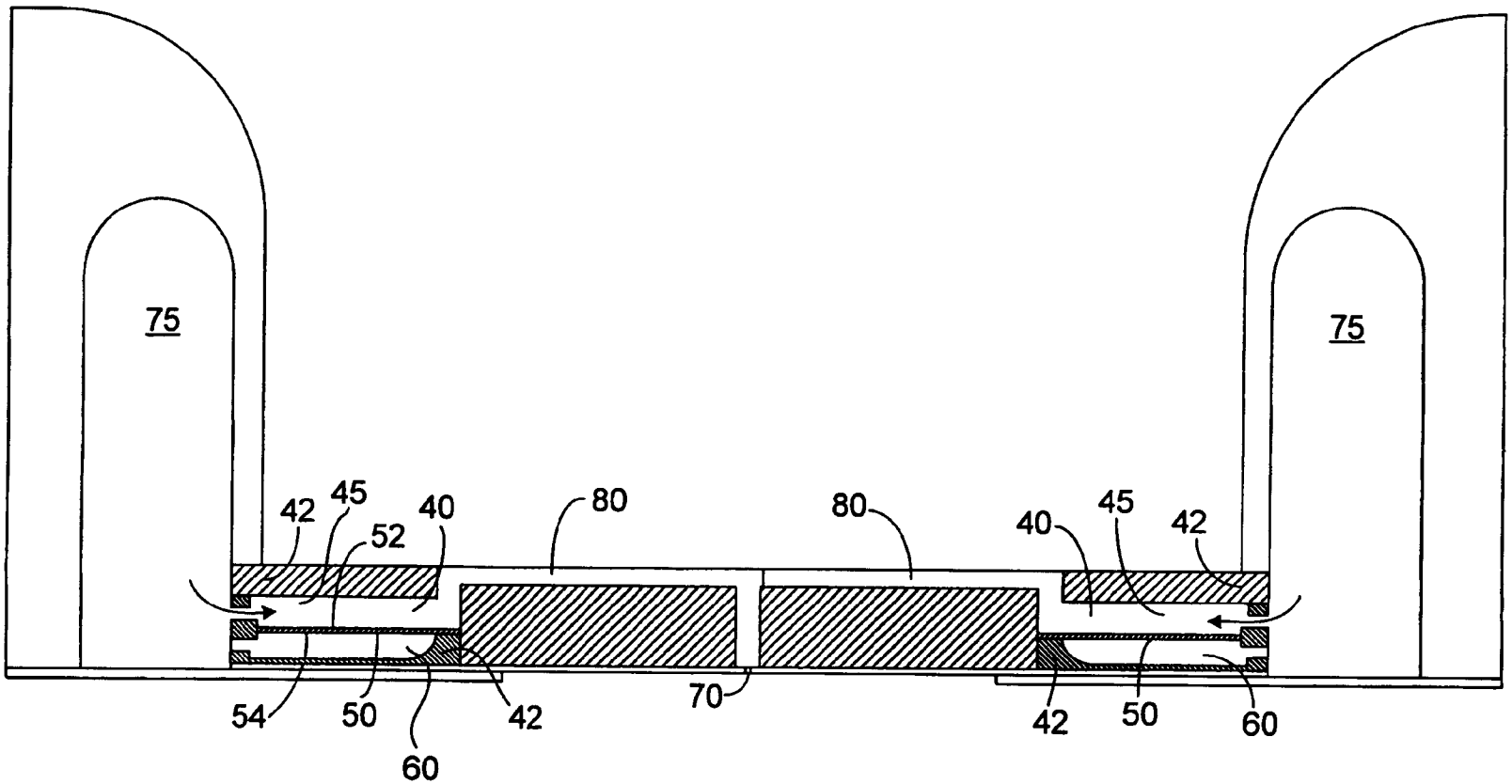
FIG. 2 is a cross-sectional view of a portion of a printhead.

Referring to FIG. 2, prior to ink ejection, the ink within the printhead (e.g., ink contained within an ink reservoir region 75) is degassed to remove bubbles and/or dissolved gasses that can interfere with print quality. To degas the ink, the ink is passed over an ink impermeable/gas permeable membrane 50 positioned within an ink flow path 40 formed within a body 42 (e.g., a semiconductor body, or a ceramic body) of the manifold assembly 30. Ink enters a deaeration portion 45 of an ink flow path 40 where the ink comes into contact with membrane 50. Membrane 50 includes an upper surface 52 that is in fluid contact with the ink in the deaeration portion 45 of the ink flow path 40 and a lower surface 54 that is in contact with a vacuum region 60. In embodiments, the membrane 50 allows gas to move through the membrane and into vacuum 60 region, while preventing liquids, such as ink, from passing through. A vacuum source is in communication with vacuum region 60. Region 60, acting on membrane 50, removes air and other gasses from the ink located within the deaeration portion 45. Once the ink is degassed the ink enters into pumping chamber 80 where it is delivered on demand to nozzle 70 for ejection. A suitable printhead is described in U.S. patent application Ser. No. 10/189,947 filed on Jul. 3, 2002, and hereby incorporated by reference in its entirety. Deaeration is discussed in U.S. patent application Ser. No. 10/782,367, filed Feb. 19, 2004, and hereby incorporated by reference in its entirety.

Figure 3:
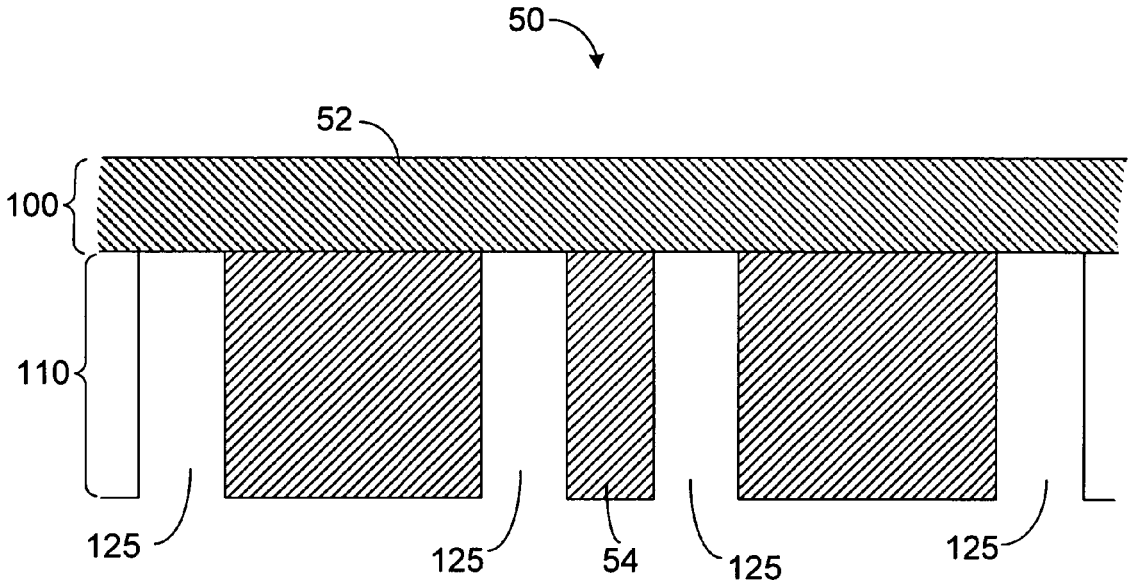
FIG. 3 is a cross-sectional view of a portion of a membrane used in the printhead of FIG. 2.

Referring to FIG. 3, semi-permeable membrane 50 can include a nitride layer 100 (e.g., a silicon nitride layer) deposited on a base layer 110 (e.g., a silicon wafer). In embodiments, the nitride layer 100 has a thickness of about 1 micron or less and base layer 110 has a thickness of about 700 microns or less. Membrane 50 is made semi-permeable by the processing described below. After this processing, membrane 50 allows gases, such as air or helium to pass through the membrane, but prevents liquids, such as inks, from passing therethrough.

Membrane 50 can be formed by depositing a silicon nitride layer on the front side of a silicon wafer. After depositing, the back side of the silicon wafer is then etched for about 10 minutes using a Bosch etch process (e.g., a Deep Reactive Ion Etch process) to form holes 125 (e.g., 100 microns in width) that extend through the base layer 110 (e.g., the silicon wafer) and intersect the silicon nitride layer 100. The Bosch etch attacks silicon more rapidly than silicon nitride and thus, can be used as a selective etchant to create the holes 125 without puncturing the nitride layer 100 of membrane 50. To make membrane 50 permeable to gases, a Plasma-Therm RIE (reactive ion etch) is applied to the holes 125. A suitable etch is accomplished using a Plasma-Therm RIE system obtained from Unaxis, Inc. Switzerland, under conditions of 8.5 sccm of Ar, 2.5 sccm of $SF_6$, and 2.5 sccm $CHF_3$ at 15 mTorr and 150 W of power for 8 minutes. After application of the Plasma-Therm RIE system, the nitride layer 100 is permeable to gases (e.g., He, air), but not to liquids. In embodiments, the reactive ion etch produces fractures, e.g., microfractures within the nitride layer 100 that have small cross-sectional dimensions that are sized (e.g., less than 250 nanometers or less than about 100 nanometers) to be permeable to gases, while preventing intrusion of a liquid, e.g. an ink, into the membrane. Further discussion of a suitable process of making membrane 50 is described in *Silicon Nitride Membranes for Filtration and Separation*, by Galambos et al., presented at SPIE Micromachining and Microfabrication Conference, San Jose, Calif., September 1999 and *Surface Micromachined Pressure Transducers*, Ph.D. Dissertation of W. P. Eaton, University of New Mexico, 1997, hereby incorporated by reference in their entirety.

The membrane 50 has sufficient strength to support a pressure difference created by a vacuum in region 60. In embodiments, membrane 50 can withstand a load of about 20 or 25 atm or more of pressure without breaking and/or transporting a fluid (e.g., water or ink) therethrough.

The permeability of membrane 50 is generally high. In embodiments, the permeability of membrane 50 to helium is $1\times10^{-9}$ moles/($m^2$Pa-s) or greater, e.g., $1\times10^{-8}$ moles/($m^2$Pa-s) or greater at room temperature. In some embodiments, the permeability of membrane 50 is 10 times or more, e.g., 100 or 200 times or more the permeability of a typical porous fluoropolymer. For example, a membrane having a permeability to helium of $1.6\times10^{-8}$ mols/($m^2$Pa-s) at room temperature (as reported in Galambos et al.) is approximately 200 times greater than the permeability of fluoropolymers (e.g., $7.92\times10^{-11}$ mols/($m^2$Pa-s) for TFE and $5.29\times10^{-11}$ mols/($m^2$Pa-s) for PTFE) that are typically used to degas ink in printheads. The permeability of membrane 50 to He at room temperature is also greater than the He permeability of typical fluoropolymers at elevated temperatures. For example, the He permeability of membrane 50 is $1.6\times10^{-8}$ mols/($m^2$Pa-s) at room temperature, which is about 16 times greater than the He permeability of fluoropolymer materials (e.g., $9.58\times10^{-10}$ mol/($m^2$Pa-s) for TFE and $7.04\times10^{-10}$ mol/($m^2$Pa-s) for PTFE) at a temperature of 125° C.

As a result of the high gas permeability, the size (e.g., geometric surface area) of membrane 50 can be reduced (as compared to conventional deaeration membranes made from fluoropolymer materials) without a decrease in degassing efficiency. In general, if the permeability of a membrane increases, the geometric surface area of the membrane can be reduced without a decrease in degassing efficiency. In certain embodiments, the relationship between increased permeability and a reduction in surface area is one to one. For example, at room temperature, the He degassing efficiency is about the same for a TFE membrane having a surface area of 200 $\mu m^2$ and a 1 μm sized membrane 50. In certain embodiments, the material forming membrane 50 has a permeability to air that is at least 100 times (e.g., at least 75 times, at least 50 times, at least 25 times) greater than a fluoropolymer material. As a result, in certain embodiments, membrane 50 can be sized as much as 100 times smaller than conventional TFE degassing membranes. This reduction in size can be particularly desirable for incorporating membrane 50 anywhere along the flow path 40.

While certain embodiments have been described, other embodiments are possible. For example, while membrane 50 has been described as being made permeable to air after application of a 8 minute Plasma-Therm reactive ion etch, other etching conditions, pressures and gases can also be used. In some embodiments, the Plasma-Therm reactive ion etch time can be increased from 8 minutes up to about 12 minutes (e.g., 9 minutes, 10 minutes, 11 minutes, 12 minutes). A membrane that has been reactive ion etched for 12 minutes has a He permeability of $1\times10^{-11}$ mols/($m^2$Pa-s) at room temperature. In some embodiments, the Plasma- Therm reactive ion etch time is decreased to about 4 minutes (e.g., 7 minutes, 6 minutes, 5 minutes, 4 minutes). In this embodiment, following the reactive ion etch, membrane 50 is pre-stressed with a 1000 torr step load, which increases the width of the microfractures within the film. As a result of the increase in width, the He permeability increases from an initial permeability of $7\times10^{-11}$ mols/($m^2$Pa-s) to a final He permeability of about $6.3\times10^{-6}$ mols/($m^2$Pa-s) at room temperature. In certain embodiments, membrane 50 does not undergo a reactive ion etch, but rather an increased time Bosch etch process. For example, a membrane exposed to a 22 minute Bosch etch has a He permeability of about $2\times10^{-11}$ mols/($m^2$Pa-s) at room temperature and a membrane exposed to a 33 minute Bosch etch has a He permeability of about $1\times10^{-9}$ mols/($m^2$Pa-s) at room temperature.

As an additional example, in certain embodiments, a printhead includes multiple flow paths. In some embodiments, a separate deaerator portion is included in each of the multiple flow paths. In other embodiments, a single deaerator portion is provided to degas multiple flow paths.

Still further embodiments follow. For example, while ink can be deaerated within and jetted from the printhead unit, the printhead unit can be utilized to eject fluids other than ink. For example, the deposited droplets may be a UV or other radiation curable material or other material, for example, chemical or biological fluids, capable of being delivered as drops. For example, the printhead unit 20 described could be part of a precision dispensing system.

All of the features disclosed herein may be combined in any combination.

All publications, applications, and patents referred to in this application are herein incorporated by reference to the same extent as if each individual publication or patent was specifically and individually indicated to be incorporated by reference in their entirety.

Still other embodiments are in the following claims.

What is claimed is:

1. A drop ejector system comprising:

a body;

a pumping chamber formed in the body in which fluid is pressurized for ejection of a fluid drop, and a membrane formed in the body adjacent to the pumping chamber comprising a semi-permeable nitride positioned in fluid contact with a flow path, wherein the membrane has a permeability to He of at least about $1.6\times10^{-8}$ mols/($m^2$Pa-s) at room temperature.

2. The drop ejector system of claim 1, wherein the membrane includes microfractures.

3. The drop ejector of claim 1, wherein the membrane is porous.

4. The drop ejector system of claim 1, wherein the membrane includes a first surface in fluid contact with the flow path and a second surface in contact with a vacuum region.

5. The drop ejector system of claim 1, wherein the membrane is permeable to gas but not to liquid.

6. The drop ejector system of claim 5, wherein the membrane is permeable to air.

7. The drop ejector system of claim 5, wherein the membrane is substantially impermeable to ink used in the drop ejector system.

8. The drop ejector system of claim 1, wherein the nitride comprises a silicon nitride.

9. The drop ejector system of claim 1, wherein the membrane was exposed to a reactive ion etchant.

10. The drop ejector system of claim 1, wherein the body comprises a semiconductor material.

11. The drop ejector system of claim 1, further comprising multiple flow paths.

12. A drop ejector system comprising:

a body;

a pumping chamber formed in the body in which fluid is pressurized for ejection of a fluid drop; and a membrane formed in the body adjacent to the pumping chamber having a permeability to He of about $1\times10^{10-10}$ mols/($m^2$Pa-s) to about $1\times10^{-6}$ mols/($m^2$Pa-s) at room temperature positioned in fluid contact with a flow path.

13. The drop ejector system of claim 12, wherein the membrane includes microfractures.

14. The drop ejector system of claim 12, wherein the membrane includes a first surface in fluid contact with the flow path and a second surface in contact with a vacuum region.

15. The drop ejector system of claim 12, wherein the membrane is also permeable to air.

16. The drop ejector system of claim 12, wherein the membrane is substantially impermeable to liquids.

17. The drop ejector system of claim 16, wherein the membrane is substantially impermeable to ink used in the drop ejector system.

18. The drop ejector system of claim 12, wherein the membrane comprises a silicon nitride membrane.

19. The drop ejector system of claim 12, wherein the membrane was exposed to a reactive ion etchant.

20. The drop ejector system of claim 12, wherein the membrane has a permeability to He of less than about $1.6\times10^{-8}$ mols/($m^2$Pa-s) at room temperature.

21. The drop ejector system of claim 12, further comprising multiple flow paths.

22. The drop ejector system of claim 12, wherein the body comprises a semiconductor material.

23. A drop ejector system comprising:

a body;

a pumping chamber formed in the body in which fluid is pressurized for ejection of a fluid drop; and a membrane formed in the body adjacent to the pumping chamber having fractures that have a cross-sectional dimension no greater than about 100 nm positioned in fluid contact with a flow path, wherein the membrane has a permeability to He of at least about $1.6\times10^{-8}$ mols/($m^2$Pa-s) at room temperature.

24. The drop ejector system of claim 23, wherein the membrane includes a first surface in fluid contact with the flow path and a second surface in contact with a vacuum region.

25. The drop ejector system of claim 23, wherein the membrane is permeable to gas but not to liquid.

26. The drop ejector system of claim 25, wherein the membrane is permeable to air.

27. The drop ejector system of claim 26, wherein the membrane is substantially impermeable to ink used in the drop ejector system.

28. The drop ejector system of claim 23, wherein the membrane comprises a silicon nitride.

29. The drop ejector system of claim 23, wherein the membrane was exposed to an reactive ion etchant.

30. The drop ejector system of claim 23, wherein the body comprises a semiconductor material.

31. The drop ejector system of claim 23, further comprising multiple flow paths.

* * * * *